United States Patent [19]

Landers et al.

[11] Patent Number: 4,641,763

[45] Date of Patent: Feb. 10, 1987

[54] ICE AND BEVERAGE DISPENSING APPARATUS AND METHOD WITH DUAL PURPOSE LINER

[75] Inventors: Jerry L. Landers; Gregory E. Fischer, both of Sellersburg, Ind.

[73] Assignee: Servend International, Jeffersonville, Ind.

[21] Appl. No.: 611,879

[22] Filed: May 18, 1984

[51] Int. Cl.[4] ..... B67D 5/56

[52] U.S. Cl. ..... 222/129.1; 222/131; 222/108; 222/146.6; 222/413; 62/344; 62/398

[58] Field of Search ..... 222/146.6, 129.1, 131, 222/135, 108, 413, 240–241; 62/344, 348, 398; 366/186, 190, 194–196

[56] References Cited

U.S. PATENT DOCUMENTS

| | | | |
|---|---|---|---|
| 566,143 | 8/1896 | Cromwell et al. | 366/186 |
| 1,713,886 | 5/1929 | Benzon . | |
| 2,692,705 | 10/1954 | Marihart . | |
| 2,694,509 | 11/1954 | Vita | 222/413 |
| 3,108,718 | 10/1963 | Seener | 222/129.1 |
| 3,605,430 | 9/1971 | Conti | 62/344 |
| 3,858,765 | 1/1975 | Landers . | |
| 4,084,725 | 4/1978 | Buchser . | |
| 4,192,151 | 3/1980 | Carpenter | 62/348 |
| 4,300,359 | 11/1981 | Koeneman et al. . | |
| 4,423,830 | 1/1984 | Lents et al. | 222/146.6 |
| 4,512,502 | 4/1985 | Larders . | |

FOREIGN PATENT DOCUMENTS

| | | |
|---|---|---|
| 3002132 | 7/1981 | Fed. Rep. of Germany . |
| 689456 | 3/1953 | United Kingdom . |

*Primary Examiner*—H. Grant Skaggs
*Attorney, Agent, or Firm*—James C. Wray

[57] ABSTRACT

Ice from an ice-making source is loaded into a bin and rests upon a curved liner which is spaced above the bottom of the bin. Ice is moved through the bin and above the liner by a wire auger toward a discharge opening. Ice gravitationally feeds through openings in the liner to a cold plate which forms the bottom of the bin. The ice chills the cold plate, chilling beverages flowing through passages in the cold plate. As ice resting on the cold plate takes up heat, the ice melts. Water is drained from above the cold plate. Foamed-in-place polyurethane insulation surrounds the bin. A motor is mounted on the front of the bin. A drive connected to the motor drives the ice-moving auger and discharge equipment. A motor controller is mounted near an ice-discharge chute. Beverage-dispenser valves are connected to the front of the cold plate and are aligned with the dispenser chute.

30 Claims, 5 Drawing Figures

ICE AND BEVERAGE DISPENSING APPARATUS AND METHOD WITH DUAL PURPOSE LINER

BACKGROUND OF THE INVENTION

The present invention concerns ice dispensers and beverage dispensers.

Cold plates through which beverage flows to be chilled consist of blocks of aluminum formed in a variety of commercially accepted shapes. Contained within the aluminum block are a series of stainless steel tubes which serve as conduits for liquid. Typically, a cold plate is used as a cooling device by keeping ice in contact with a cold plate. The aluminum plate removes heat from the stainless steel tubes as beverage within the tubes is cooled. Typically, liquid enters the cooling plate in a noncooled form at ambient temperature as liquid passes through the tubing within the cold plate. The liquid which is usually under pressure in the stainless steel tubes is chilled so that, when it is dispensed, a maximum amount of carbon dioxide may be dissolved in the cooled liquid. The heat transfer between the warmer liquid and the cold plate naturally melts the ice contacting the cold plate. Fresh ice must be applied to the cold plate to ensure the quality of the beverages.

The present invention solves the problem of continuously supplying ice to the cold plate, where the ice is melted to chill the cold plate while, at the same time, providing high-quality hard ice to a dispenser to be mixed with the beverages when the beverages are sold.

SUMMARY OF THE INVENTION

Ice from an ice-making source is loaded into a bin and rests upon a curved liner which is spaced above the bottom of the bin. Ice is moved through the bin and above the liner by a wire auger toward a discharge opening. Ice gravitationally feeds through openings in the liner to a cold plate which forms the bottom of the bin. The ice chills the cold plate, chilling beverages flowing through passages in the cold plate. As ice resting on the cold plate takes up heat, the ice melts. Water is drained from above the cold plate. Foamed-in-place polyurethane insulation surrounds the bin. A motor is mounted on the front of the bin. A drive connected to the motor drives the ice-moving auger and discharge equipment. A motor controller is mounted near an ice-discharge chute. Beverage-dispenser valves are connected to the front of the cold plate and are aligned with the dispenser chute.

The invention encompasses a cold-plate system for an ice dispenser.

The invention uses a bin liner which allows maximum effectiveness of the ice contained within an ice/beverage dispensing bin for the intended purpose of the ice.

The ice is dispensed into a container for cooling products contained therein, and the ice provides a cooling source for the cold plate.

The bin liner is a flat or rolled piece of plastic or stainless steel. One side is passed under an ice-dispensing auger and is moved toward the top of the bin. Edges of the liner are fastened near top edges on opposite sides of the bin. The liner is held spaced above the cold plate.

Insertion of the liner into a bin in which the bottom is an integrally sealed cold plate allows an increased efficiency of an ice dispenser. The dispenser provides maximum possible delivery of the stored ice while maintaining ice in constant contact with a cold plate.

The bin liner increases efficiency of the machine by altering the functional ice-dispensing shape of the bin from a rectangular shape to a semicylindrical shape. That allows a greater percentage of the ice to be dispensed, since the machine relies on gravity to guide the ice toward the dispensing auger. Without a semicylindrical shape of the bin, the ice would simply bridge across a tunnel formed in the center of the bin, thereby affording inefficient use of the ice for dispensing purposes. The liner alters the effective shape of the bin.

The liner allows ice to be in constant contact with a cold plate due to a series of holes that are strategically located on the liner. The holes allow ice to drop through the liner, thereby replenishing a layer of ice on the cold plate as ice melts away as the beverages pass through the cold plate.

Since the liner rests above the cold plate, the dispensed ice never comes in contact with the cold plate. That is desirable because ice that comes in contact with the cold plate, if not totally melted, may be soft or watered down or have a liquid surface which may undesirably alter the state of the dispensed liquid that the ice is being used to cool.

A further benefit of the bin liner is seen in the actual manufacturing process of ice/beverage dispensers. Since commercially accepted cold plates are available in flat, planar shapes, it is desirable to manufacture ice-container bins with flat side walls and bottoms.

By integrating the cold plate as part of the flat bottom of the bin, the manufacturing process is simplified. The simple process of inserting the bin liner alters the bin shape as it pertains to ice dispensing to the desired state.

The present invention minimizes space, uses maximum cooling capacity of the ice and delivers a high percentage of the ice. The present invention delivers a high-quality ice and maintains a cool drink from the initial loading of the ice until all of the ice is dispensed. The present invention provides an ease of construction and an ease of cleaning.

A preferred ice dispensing machine includes bin means for holding ice, liner means within the bin means for supporting a portion of the ice above a bottom of the bin means and opening means in the liner means for permitting ice to move through the opening means from one side of the liner means to another side of the liner means toward a bottom of the bin means. Discharge means is connected to the bin means for discharging ice from the bin means. Moving means mounted in the bin means above the liner means moves ice within the bin means.

Preferably, the discharge means is connected to the bin means adjacent the moving means for discharging ice moved to the discharge means by the moving means.

Preferably, the liner means comprises a sheet of material, which extends between side walls of the bin means.

Preferably, the liner sheet is downwardly curved when extended between opposite side walls of the bin means. Upper opposite edge portions of the sheet material are attached to the bin means at upper edge portions of opposite side walls. The moving means is mounted in the bin means above the downward curvature of the sheet means, and the discharge means is mounted in the bin means at one end of the moving means. Preferably, the discharge means is mounted above the moving means. Preferably, the discharge means is mounted above the sheet means.

A preferred embodiment of the invention includes cold plate means mounted at the bottom of the bin means. The cold plate means has passages therethrough for flowing material to be cooled by ice passing through opening means in the sheet material toward the bottom of the bin means.

Preferably, the cold plate is spaced downward from the liner means.

In a preferred embodiment, the cold plate is generally rectangular. The cold plate has four rectangularly oriented upper edges. The bin means has four rectangularly oriented side walls extending upward from respective upper edges of the cold plate. The liner means is a rectangular sheet of material having one transverse dimension equivalent to a similar transverse dimension of the cold plate and having a second transverse dimension greater than a second transverse dimension of the cold plate. The sheet material is curved so that the second transverse dimension is curved. Fastening means attach edges of the sheet material at opposite ends of the second relatively larger transverse dimension to upper portions of opposite walls of the bin means.

Preferably, the fastening means are four thumb screws for extending through openings near corners of the sheet material and into upper portions of opposite side walls.

In a preferred embodiment, insulation material surrounds side walls of the bin. A cover is mounted on top of side walls of the bin. A motor mounted externally on a front of the bin drives apparatus connected to the motor means and extended through the bin. Moving means mounted in the bin above the liner are connected to the driving means, and discharge means mounted adjacent the moving means are connected to the driving means. A motor controller is mounted on the front of the bin adjacent the discharge means and is connected to the motor for controlling the motor. Plural beverage dispensing means are connected to the cold plate, are communicated with passages extending through the cold plate, and are positioned near the front of the bin adjacent the discharge means for dispensing beverages.

A preferred method of dispensing ice includes storing ice above a liner in a bin, permitting ice to fall through openings in the liner toward a bottom of the bin, moving ice above the liner toward a discharge outlet and discharging ice from the discharge outlet.

The preferred method includes chilling a bottom of the bin with ice falling through openings in the lining and removing from a bottom of the bin water formed by ice melting on the bottom of the bin and taking up heat from the bottom of the bin.

The preferred method includes flowing beverages through a cold plate at the bottom of the bin.

The preferred method includes inserting the liner in the bin by bending a sheet material beneath a moving means positioned in the bin into a downwardly curving liner and attaching upper edges of the liner to upper edges of the bin.

These and other and further objects and features of the invention are apparent in the disclosure, which includes the above and ongoing written specification, with the claims and the drawings.

DETAILED DESCRIPTION OF THE DRAWINGS

Figure 1:
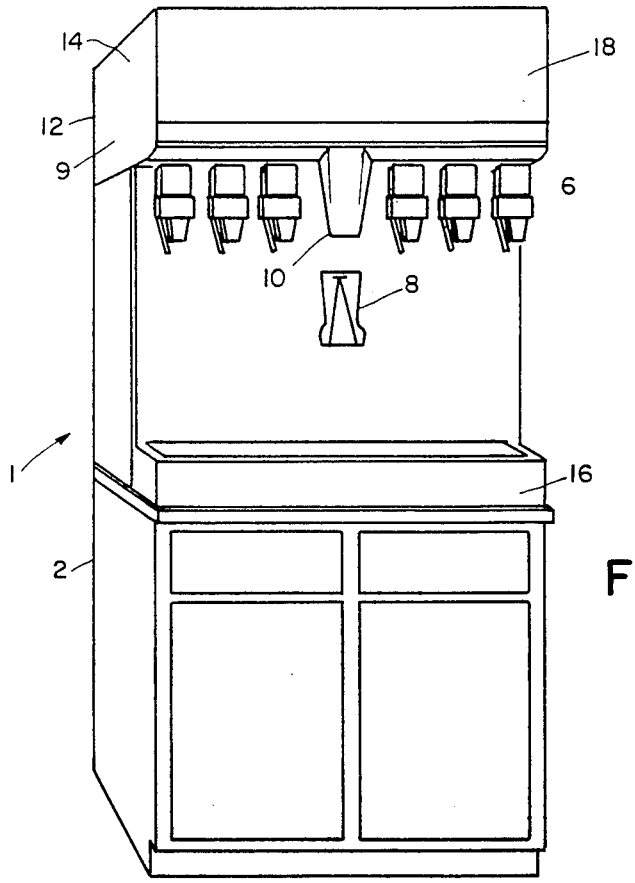
FIG. 1 is a perspective view of the beverage and ice dispenser of the present invention.
Figure 2:
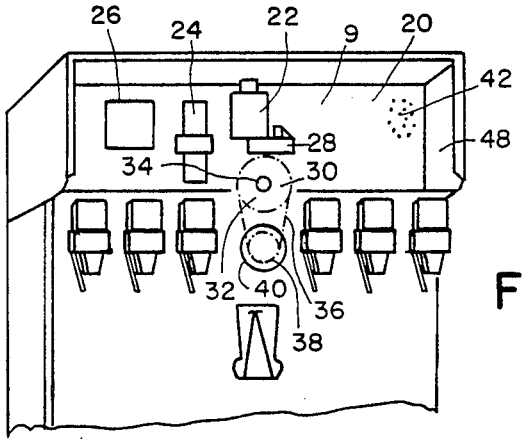
FIG. 2 is a detail of the ice-moving and dispensing motor and controls.

Referring to FIG. 1, and ice and beverage dispenser is generally indicated by the numeral 1. The dispenser is mounted on a storage cabinet 2 in which cups and other materials may be stored.

The upper cabinet 4 supports beverage valves 6, are aligned in the front of a cold plate and an ice dispenser switch 8 mounted beneath an ice dispenser chute 10. An upper part 12 of cabinet 4 encloses an ice-storage bin 9. A forward part 14 of the cabinet encloses an ice-dispenser motor and controllers. A scrap ice and beverage collector 16 is mounted at the bottom of the upper cabinet.

Cover 18 is removed from the embodiment in FIG. 1 to show the motor-mounting area 20. A small drive motor 22 controlled by a capacitor 24 and supplied with current from junction box 26, which operates through reduction gears 28 to drive drive means 30, which includes a drive gear 32 with a shaft 34 connected to the ice-moving auger.

A chain 36 is connected to a gear 38 which controls the ice dispensor 40. Motor 22 is started when switch 8 is pushed rearward, such as by pushing a cup against the switch.

Foamed-in-place polyurethane insulation 42 surrounds the bin. A fairing 48 extends outward from a front of the bin to cooperate with the cover 18 to provide the motor enclosure 20.

Figure 3:
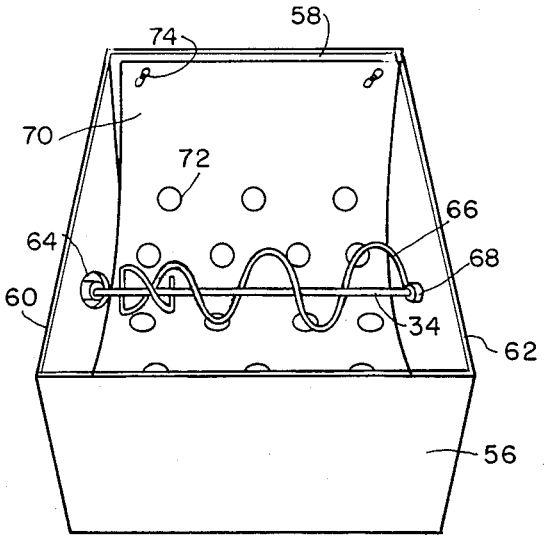
FIG. 3 is a top perspective view of the ice bin of the present invention.
Figure 4:
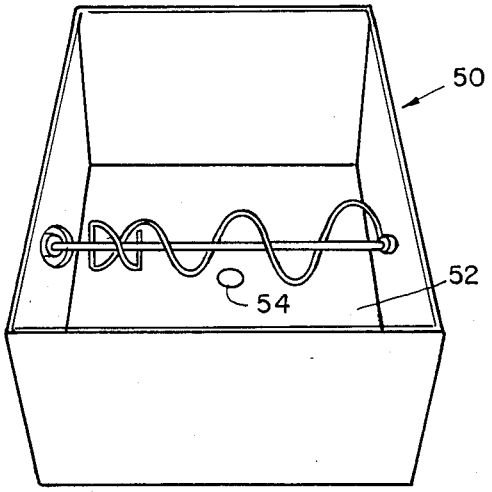
FIG. 4 is a top perspective view of the ice bin of the present invention from which the liner has been removed.
Figure 5:
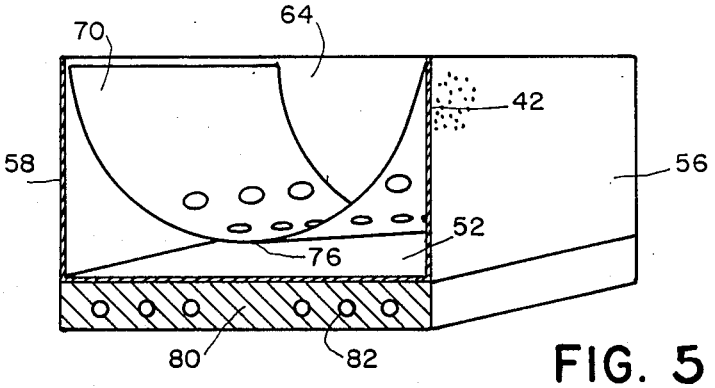
FIG. 5 is a view partially in cross section showing the ice bin, cold plate and liner of the present invention.

Referring to FIGS. 3, 4 and 5, an ice bin generally indicated by the numeral 50 is formed with a flat bottom 52 having a central drain 54. Rectangular side walls 56 and 58 extend upward from the bin bottom 52. Insulation materials 42 surround sidewalls of the bin. Front and back walls 60 and 62 complete the rectangular bin. An opening 64 in the front wall provides a discharge opening for the ice. An auger 66 mounted on driven shaft 34 moves the ice through the bin. The large dimension of the auger near the rear wall 62 and the small dimension of the auger near the discharge opening 64 encourage breaking of ice bridges and clumps and movement of the ice forward to the opening. A bushing 68 in the rear wall 64 supports the shaft 34.

In the preferred embodiment of the invention, liner 70 is formed of a stainless steel sheet with openings 72 through which ice drops to the bottom 52 of the bin. Preferably, the sheet 70 is attached by thumb screws 74 near upper edges of the sheet to upper edge portions of the opposite side walls 56 and 58.

In the preferred embodiment of the invention, 14 holes are provided in the liner. The holes are approximately 2" to 2½" in diameter. Eight of the holes are arranged in two closely spaced rows of four holes each directly under the auger. Six of the holes are upwardly spaced along the walls of the liner and are arranged in relatively widely spaced rows of three holes each. The liner may be positioned tightly against the forward and rearward walls 60 and 62. Alternatively and preferably, the liner may be spaced slightly from the forward wall 60.

Ice is supplied in the bin by first removing a cover from the top of a bin and then dumping a bag of ice into the bin. The ice employed is of such size that pieces will fit through the openings in the liner. Undersized pieces of ice tend to fall more readily through the opening. As the ice is pushed forward, any extremely undersized pieces may slip between the forward edge of the liner and the forward wall 60 of the bin.

In a preferred embodiment of the invention, the bin is formed of stainless steel sheet material which may be readily cleaned. In one form of the invention, the bottom 52 of the bin is replaced by directly mounting the side walls 56 and 58 and the front and rear walls 60 and 62 on the cold plate 80. Ice in direct contact with the aluminum cold plate 80 provides rapid chilling of beverage flowing through passages 82. In a preferred embodiment, passages 82 are formed by stainless steel tubes which are fitted tightly within openings formed or drilled in the aluminum block of the cold plate 80 or by tubes embedded in the cold plate as it is cast.

In the preferred form of the invention, the liner 70 forms a semicylindrical shape with a curved lower portion 76 which is spaced upward from the bottom 52 of the bin.

In operation, an empty cup is placed beneath the chute 10. Switch 8 is pushed rearward by the empty cup, causing the motor 22 to turn shaft 34 and auger 66 to move the ice forward in bin 50. The ice passes through the discharge opening 64 and downward through the chute where its discharge is controlled.

Releasing switch 8 stops the dispensing of the ice, and a cup is placed under one of the selected beverage valves 6. Moving the lever on the beverage valve causes beverage from chilled tube 82 to fill the cup. As the ambient temperature beverage flows through the tube, the aluminum plate 80 acts a a heat sink to rapidly conduct heat away from the tube 82 and the beverage therein, chilling the beverage before it hits the ice in the cup.

While the invention has been described with reference to a specific embodiment, modifications and variations of the invention may be constructed without departing from the scope of the invention. The scope of the invention is defined in the following claims.

We claim:

1. Ice dispensing apparatus for storing ice, chilling beverages, dispensing ice and dispensing beverages comprising an ice storage bin means having a bottom and generally rectangular walls extending upward from the bottom to a top through which ice is dumped into the bin means and having an ice dispensing opening for dispensing ice from the bin means, a cold plate at the bottom of the bin means and passages in the cold plate for flowing beverages through the cold plate, and beverage dispenser valves connected to the passages, an auger above the cold plate centered midway between side edges thereof, the auger extending between opposite walls of the bin above a liner means for moving stored ice over the liner means through the bin means and towards the dispensing opening the liner means being positioned in the bin means near the bottom of the bin means and extending downward from walls of the bin means and inward within the bin means beneath the auger for supporting ice above the liner means in the bin means and for altering a shape of an ice storage volume of the bin means, the liner means being formed of sheet material and the sheet material having spaced openings of such size that pieces of ice stored in the bin means above the liner means fit through the openings and drop to the bottom for chilling the cold plate and beverages in passages therein, the auger means cooperating with the openings in the liner means to distribute ice generally over an entire upper surface of the cold plate whereby the liner means alters a functional ice-dispensing shape of the bin means and cooperates with the bin means for allowing a greater percentage of stored ice to be dispensed, and whereby the auger moves ice over the sheet material liner means towards the ice dispensing openings and whereby the auger, the sheet material liner means and the openings therein cooperate as the auger moves stored ice through the bin and over the sheet material liner means so that some of the moving stored ice drops through the openings in the sheet material liner means toward the cold plate and thereby replenishes a layer of ice on the cold plate.

2. The ice dispensing apparatus of claim 1 further comprising discharge means connected to the discharge opening for discharging ice from the bin means.

3. The ice dispensing apparatus of claim 1 further comprising moving means mounted on the bin means above the liner means for moving the auger within the bin means above the liner means.

4. The ice dispensing apparatus of claim 3 further comprising discharge means connected to the bin means adjacent the moving means for discharging ice moved to the discharge opening by the moving means.

5. The ice dispensing apparatus of claim 1 wherein the liner means comprises one sheet of material.

6. The ice dispensing apparatus of claim 5 wherein the sheet of material extends between side walls of the bin means.

7. The ice dispensing apparatus of claim 6 wherein the sheet of material is downwardly curved when extended between opposite side walls of the bin means.

8. The ice dispensing apparatus of claim 7 wherein upper opposite edge portions of the sheet of material are attached to the bin means at upper edge portions of opposite side walls.

9. The ice dispensing apparatus of claim 8 further comprising auger moving means mounted on the bin means above a downward curvature of the sheet and discharge means mounted on the bin means at one end of the moving means.

10. The ice dispensing apparatus of claim 9 wherein the discharge means is mounted above the sheet.

11. The ice dispensing apparatus of claim 1 further wherein the cold plate is mounted as the bottom of the bin means beneath the liner means.

12. The ice dispensing apparatus of claim 11 wherein the cold plate is spaced downward from the liner means.

13. The apparatus of claim 12 wherein the cold plate is generally rectangular and wherein the cold plate has four rectangularly oriented upper edges and wherein the bin means comprises four rectangularly oriented side walls extending upward from respective upper edges of the cold plate, wherein the liner means comprises a rectangular sheet material having one transverse dimension equivalent to a similar transverse dimension of the cold plate and having a second transverse dimension greater than a second transverse dimension of the cold plate, the sheet material being curved so that the second transverse dimension is curved and further comprising means for attaching edges of the sheet material at opposite ends of the second relatively larger transverse dimension to upper portions of opposite walls of the bin means.

14. The ice dispensing apparatus of claim 13 wherein the means for attaching comprise four thumb screws for extending through openings near corners of the sheet material and in upper portions of opposite side walls.

15. The apparatus of claim 1 further comprising insulation materials surrounding side walls of the bin means, cover means mounted on top of side walls of the bin means, motor means mounted externally on a front of the bin means, driving apparatus connected to the motor means and to the auger and extending through the bin means, moving means mounted on the bin means above the liner and connected to the driving means and discharge means mounted adjacent the moving means and connected to the driving means, a motor controller connected to the front of the bin means adjacent the discharge means and connected to the motor for controlling the motor, plural beverage dispensing means connected to the cold plate and communicating with passages extending through the cold plate and positioned near the front of the bin means adjacent the discharge means for dispensing beverages.

16. The apparatus of claim 1 wherein the liner means is formed in the bin means by inserting the liner means in the bin means by bending a sheet material beneath the auger positioned in the bin means into a downwardly curving liner means and attaching upper edges of the liner means to upper edges of the bin means.

17. The apparatus of claim 1 wherein the openings comprise about $2\frac{1}{2}$ inch holes.

18. The apparatus of claim 17 wherein multiple holes are arranged in the liner means.

19. The apparatus of claim 1 wherein the openings are holes arranged in spaced rows.

20. The apparatus of claim 19 wherein some of the holes are arranged in relatively closely spaced rows beneath an auger and some of the holes are spaced upwardly along the liner.

21. The method of storing ice, dispensing ice and chilling beverages comprising placing ice into a bin, supporting ice on a liner means made of sheet material extending downward and inward within the bin, moving ice downward and inward along the sheet material liner means, turning an auger above the liner means, moving ice through the bin above the sheet material liner means and toward a dispensing opening in the bin, permitting some of the stored ice to fall through spaced openings in the sheet material liner means, supporting ice that falls through the openings on a cold plate which forms a bottom of the bin, the auger being centered above the cold plate between side edges thereof and the auger cooperating with openings in the liner means to distribute ice generally over an entire upper surface of the cold plate, flowing beverages through passages in the cold plate, melting ice on the cold plate and chilling beverages in the passages, dispensing ice from the bin, and dispensing beverages from the cold plate.

22. The method of claim 21 wherein the step of placing ice into the bin comprises dumping into the bin pieces of ice having such size that the ice will fit through the openings in the liner.

23. The method of claim 21, wherein the permitting ice to fall comprises permitting ice to fall through about $2\frac{1}{2}$ inch holes.

24. The method of claim 21 wherein the permitting comprises permitting ice to fall through holes arranged in spaced rows on the liner.

25. The method of claim 21 wherein the ice falls through holes arranged in two spaced rows under an auger and through holes arranged upwardly along the liner means.

26. Ice storing and dispensing apparatus comprising a bin for storing ice, a cold plate at a bottom of the bin, passages in the cold plate for flowing beverages through the cold plate, a liner within the bin spaced above the bottom for supporting a portion of the stored ice above the liner spaced from the bottom of the bin, openings in the liner for permitting a portion of the stored ice to move through the openings and to fall to the bottom of the bin for contacting the ice with the cold plate at the bottom of the bin, an auger being centered above the cold plate between side edges thereof and the auger cooperating with openings in the liner means to distribute ice generally over an entire upper surface of the cold plate, a dispenser connected to the bin above the liner for dispensing ice stored from above the liner.

27. The ice storing and dispensing apparatus of claim 26 wherein the liner comprises a sheet of material which extends between side walls of the bin and which is downwardly curved and wherein upper opposite edge portions of the sheet of material are attached to the bin on opposite side walls.

28. The ice storing and dispensing apparatus of claim 26 wherein the auger is mounted in the bin above a downward curvature of the sheet and further comprising discharge means mounted in the bin at one end of the auger, the discharge means being mounted above the sheet.

29. The ice storing and dispensing apparatus of claim 28 wherein the auger comprises a helical rod auger closely spaced from a central portion of the liner and having a large end remote from the discharge means and a small end near the discharge means.

30. The ice storing and dispensing apparatus of claim 26 wherein the openings have such a size that pieces of ice stored in the bin will fit through the openings.

* * * * *